United States Patent [19]

Sonobe et al.

[11] Patent Number: 5,036,290

[45] Date of Patent: Jul. 30, 1991

[54] SYNCHROTRON RADIATION GENERATION APPARATUS

[75] Inventors: Tadasi Sonobe, Iwaki; Mamoru Katane; Takashi Ikeguchi, both of Hitachi; Manabu Matsumoto, Ibaraki; Shinjiro Ueda, Abiko; Toshiaki Kobari, Chiyoda; Takao Takahashi, Hitachi; Toa Hayasaka, Atsugi; Toyoki Kitayama, Isehara, all of Japan

[73] Assignees: Hitachi, Ltd.; Nippon Telegraph and Telephone Corp., both of Tokyo, Japan

[21] Appl. No.: 490,450

[22] Filed: Mar. 8, 1990

[30] Foreign Application Priority Data

Mar. 15, 1989 [JP] Japan ..... 1-60979

[51] Int. Cl.[5] ..... H05H 13/04; H01J 7/16

[52] U.S. Cl. ..... 328/235; 313/7; 313/156

[58] Field of Search ..... 313/7, 156; 328/235, 328/233

[56] References Cited

U.S. PATENT DOCUMENTS 4,740,758 4/1988 Ries ..... 313/156 X
4,853,640 8/1989 Matsumoto et al. ..... 328/235
4,931,744 6/1990 Sonobe et al. ..... 328/235

FOREIGN PATENT DOCUMENTS 0278504 8/1988 European Pat. Off. .

OTHER PUBLICATIONS

"Design of UVSOR Storage Ring," by M. Okazuki, Institute of Molecular Science, Dec. 1982, pp. 56, 57.

*Primary Examiner*—Palmer C. DeMeo
*Attorney, Agent, or Firm*—Antonelli, Terry, Stout & Kraus

[57] ABSTRACT

Synchrotron radiation is generated when a base of charged particles is bent by a bending magnet. The synchrotron radiation passes down a lead-out duct as the total number of pumps is limited by the size of the apparatus and many pumps are needed in order to achieve a good vacuum. An ion pump has a main magnetic field, normally generated by a magnet of the ion pump which controls the behavior of the electrons in the ion pump. However, the leakage magnetic field of the bending magnet affects the ion pump, and therefore the ion pump is arranged so that its main magnetic field is aligned with the leakage magnetic field at the ion pump, or at least with a main component thereof. In this way, the effect of the leakage magnetic field on the ion pump is reduced. Indeed, it is possible to use the leakage magnetic field as the main magnetic field of the ion pump.

34 Claims, 4 Drawing Sheets

SYNCHROTRON RADIATION GENERATION APPARATUS

BACKGROUND OF THE INVENTION

1. Field of the Invention

The present invention relates to a method and apparatus for generating synchrotron radiation, and a system involving such an apparatus.

2. Summary of the Prior Art

A storage ring is one example of a conventional synchrotron radiation generation apparatus (hereinafter SOR apparatus) for generating synchrotron radiation (hereinafter SOR radiation). In such a storage ring, a beam of charged particles such as electrons is caused to follow a looped path, under the influence of a series of bending magnets. Each bending magnet generates a bending magnetic field, which causes the beam to bend at that magnet. The path followed by the beam must be at very low pressure, and different types of vacuum pumps are used to achieve this. In the SOR apparatus described on pages 56 and 57 of the article "UVSOR Storage Ring", published by Science Research Institute (December 1982) the, deflection region where the beam of charged particles is bent does not have any vacuum pumps other than an ion pump. Other types of pumps which may be necessary, such as titanium pumps, are positioned between the bending magnets. This is because the conventional storage ring described in the above article is large, and there is plenty of space between the magnets for the pumps that are needed.

A further type of SOR apparatus is disclosed in EP-A-0278504 and corresponding U.S. Pat. No. 4,853,640. The SOR apparatus disclosed is generally similar to FIG. 1 of the accompanying drawings, in which the path of the electron beam comprises two straight regions 10, 11 extending generally parallel, with the ends of those straight regions 10,11 being joined by a semi-circular curved region 12,13. A single bending magnet 2 (FIG. 2) is provided adjacent to the semi-circular regions 12,13 respectively, to cause the beam to be bent through the corresponding semi-circle. Two inflectors 14,15 are provided along one of the straight regions 11, with one inflector 14 being connected via gate valves 16 to a turbo molecular pump 17. Further gate valves 18 and 19 are respectively connected to the two inflectors 14, 15. An RF cavity 20 is provided in the other of the straight regions 10 of the beam path, for accelerating the beam. Furthermore, at each point 21 along the path, there is provided a titanium getter pump and a turbo-molecular pump and at the points 22 are provided two titanium getter pumps.

In the SOR apparatus shown in FIG. 1, each semi-circular region 12,13 has four synchrotron radiation ducts 23 extending therefrom. When a beam of charged particles, such as electrons, is caused to move in a curved path, such as around the semi-circular regions 12,13, synchrotron radiation is generated and is caused to pass down the ducts 23.

In FIG. 2, a beam duct 1 is shaped to correspond to the semi-circular parts of the beam path 12,13 in FIG. 1. The core of a C-shaped bending electromagnet 2 surrounds the beam duct 1 so that the central axis of the beam duct 1 substantially corresponds to the center of the magnetic field generated by the bending magnet 2, with the bending electromagnet generating a leakage field 14.

An SOR radiation lead-out duct 3 corresponds to the ducts 23 in FIG. 1, and SOR radiation is emitted from windows 3*a* (FIG. 2) on the outer peripheral side of the beam duct 1, in the plane of the beam duct 1 and in a tangential direction. The outer edge of the lead-out duct 3 is sealed by a gate valve 5 and a seal flange 6 and is connected to a radiation beam line 7 which carries the synchrotron radiation beam to a user thereof.

An ion pump 4 is provided at the wall of the lead-out duct 3 between the outer frame of the core of the bending magnet 2 and the gate valve 5.

A standard ion pump has field generation means for generating a magnetic field therein, and in the conventional SOR apparatus, this field is aligned with the direction of elongation of the duct 3.

SUMMARY OF THE INVENTION

The type of SOR apparatus shown in FIGS. 1 and 2 was developed for industrial use. Standard SOR apparatuses have been used for scientific study, and the size and cost thereof is not critical. However, in an SOR apparatus for industrial use, the size and cost becomes extremely important.

For industrial use, the arc of the beam duct, and the corresponding arc of the bending magnet for bending the beam, must be small, and the field intensity of the magnetic field produced by the bending magnet must be large therefore, a superconductive electromagnet may be used. As the size of the storage ring increases, the space permitted for pumps, etc., decreases and therefore it is increasingly important that an ion pump be connected to the duct for the synchrotron radiation. This is because a decrease in the size of the path for the beam reduces the number of pumps that may be included within that path, and, in order to provide a satisfactory degree of vacuum, pumps become necessary in the ducts.

However, it has been determined that the leakage magnetic field generated by the electromagnet may have an effect on the ion pump. In a standard ion pump, electrons are contained within a predetermined region by a main magnetic field, which is normally generated by suitable field generation means of the ion pump. It has been found that the presence of the leakage magnetic field from the bending magnet will change the net direction of magnetic field within the ion pump, and this change in direction will reduce efficiency of the ion pump. Therefore, according to the present invention the orientation of a ion pump is controlled so as to prevent or ameliorate this problem.

There are several ways that this can be done. The simplest way to align the magnetic field of the ion pump with the main (i.e. largest) component of the leakage magnetic field. In this way, only the smaller components of the leakage magnetic field influence the ion pump and normally these are sufficiently small to be neglected. Thus, for example, if the ion pump is located in a direction spaced perpendicularly from the plane of the arc of the bending magnet, the main component will be a radial component. On the other hand, if the ion pump is spaced from the duct in the plane of the arc of the bending magnet, then the main component will be perpendicular to that plane. Thus, the orientation of the magnetic field of the ion pump will depend on its location relative to the duct and bending magnet.

In a further development, however, the vector composite direction of the leakage magnetic field is determined. If the main magnetic field of the ion pump is then aligned with that vector composite direction, the vector composite field will simply add to the magnetic field of the ion pump, and thus the performance of the ion pump will not be affected by the leakage magnetic field.

This alignment of the magnetic field of the ion pump will thus cause that field to be angled relative to the direction of elongation of the duct for the synchrotron radiation.

One known form of ion pump has one or more hollow cylindrical anodes which define a region for electrons. In this case, it is the direction of that anode axis relative to the leakage magnetic field that will be important. Another type of ion pump has one or more anode plates, with holes therein, and in this case the through axis of those holes will be aligned with the leakage magnetic field as discussed above.

In a further development of the present invention, the ion pump may have a shield for shielding the ion pump from components of the leakage magnetic field other than the main component, or may be surrounded by shielding material.

The appreciation that the leakage magnetic field will have an effect on the ion pump leads to a further feature of the present invention. As was mentioned above, standard ion pumps have some means for generating a main magnetic field therein. However, since an ion pump used in a synchrotron radiation generation apparatus will be located in a magnetic field (i.e. the leakage magnetic field), it is therefore possible to use the leakage magnetic field itself as the magnetic field of the ion pump.

BRIEF DESCRIPTION OF THE DRAWINGS

Embodiments of the present invention will now be described in detail, by way of example, with reference to the accompanying drawings in which.

DETAILED DESCRIPTION

Before describing embodiments of the present invention in detail, it should be appreciated that the electron synchrotron frequency in a magnetic field is expressed by the following formula:

$$f = \frac{Be}{2\pi m}$$

where B is flux density; e is the charge on the electron; and m is the mass of the electron.

Since the frequency f of the synchrotron radiation increases in proportion to the flux density B, an increase in that flux density B increases the number of times electrons interact with gas molecules to be removed from the synchrotron radiation duct, so that performance is improved if the flux density B is increased.

Before describing a first embodiment of the present invention, a first ion pump which may be used in the present invention will be described with reference to FIG. 3.

Figure 3:
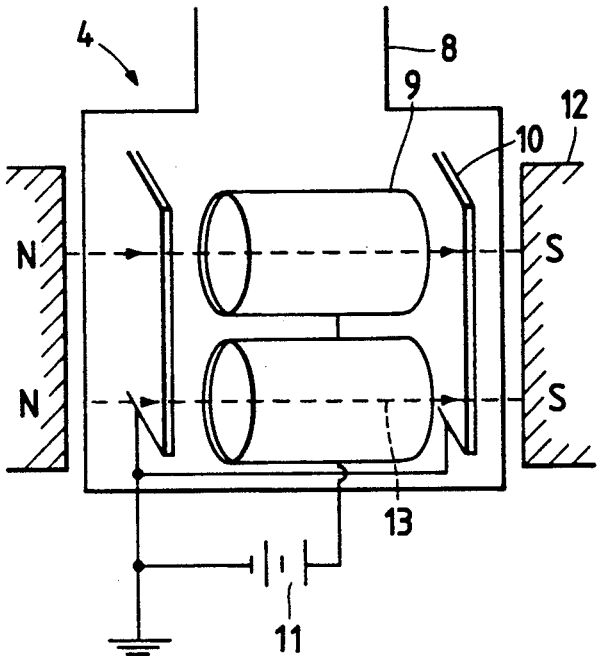
FIG. 3 (PRIOR ART)
FIG. 3 shows one type of ion pump which may be used in the present invention.

In FIG. 3 the ion pump includes an ion pump case 8, which contains therein a large number of hollow anodes 9, and cathodes 10 are located on respective sides of the anodes 9. These anodes 9 and cathodes 10 are connected to a power source 11. A magnet 12 is fitted to the outside of the pump case 8 so that the axial direction of the hollow anode 9 corresponds to the direction of field of the magnet 12 that is, the main magnetic field 13 of the ion pump.

The reason for this arrangement is as follows. Electrons move inside the hollow of the anodes 9 in the direction of the main magnetic field 13 of the ion pump. They interact with the main magnetic field 13 of the ion pump and move with electron synchrotron motion. However, the electrons are retained within the anodes 9 by the electric field of the cathodes 10 at both ends. Thus, the electrons are entrapped within the hollow anodes 9 and form an electron cloud.

When gas molecules to be exhausted by the ion pump pass into this electron cloud, they interact with the electrons and are ionized so that the ions are attracted by the electric field of the cathode 10 at the outlet of the anodes 9, thereby causing the pumping operation of the ion pump.

So that the pumping operation operates in a satisfactory manner, therefore, it is important to entrap the electron cloud inside the anodes 9, and this is normally done by bringing the axial direction of the hollow anode 9 into conformity with the direction of the main magnetic field 13 of the ion pump.

Figure 2:
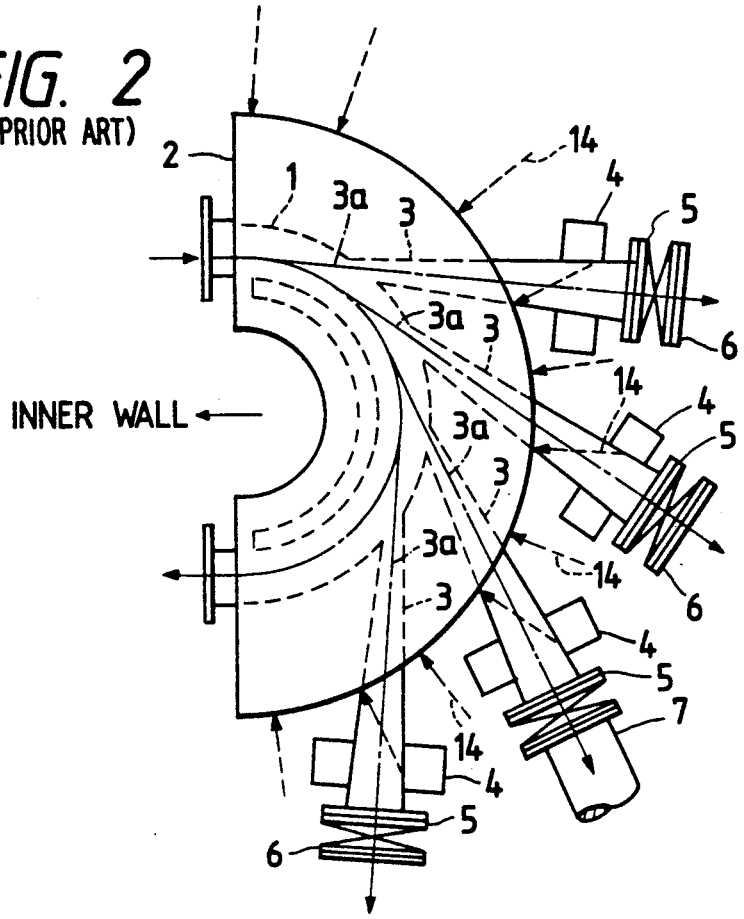
FIG. 2 (PRIOR ART)
FIG. 2 shows in more detail a part of the known synchrotron radiation generation system of FIG. 1.

It can be appreciated that if an ion pump having the construction described above is located at an intermediate part of the lead-out duct 3 on the outer peripheral side of the bending magnet 2 in FIG. 2., a leakage field exists due to the bending magnet. Therefore the leakage field of the bending magnet affects the ion pump and the electron cloud cannot be confined in the anodes 9 even through the axial direction of the hollow anodes 9 and the direction of the main magnetic field 13 of the ion pump are brought into conformity with each other. Thus, the pumping performance of the ion pump is reduced drastically and this tendency is particularly significant when the bending magnet 2 is a superconductor electromagnet.

Figure 1:
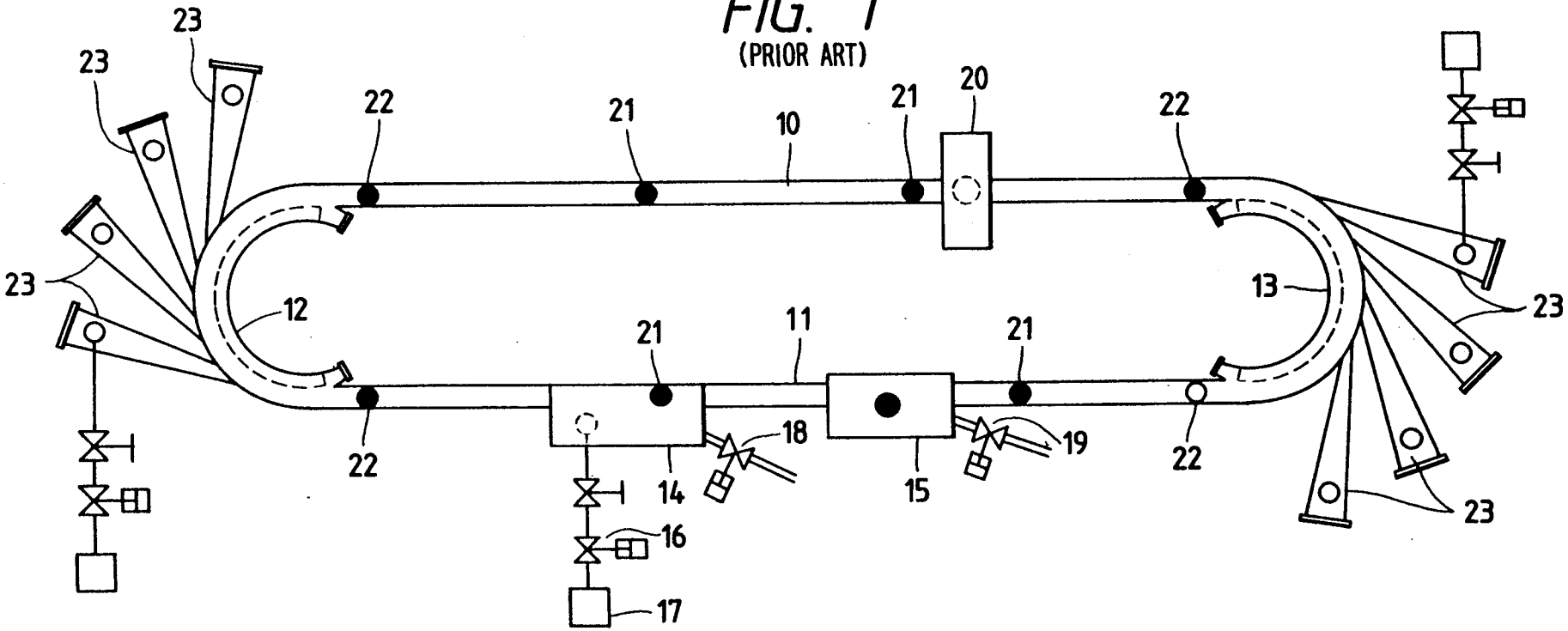
FIG. 1 (PRIOR ART)
FIG. 1 is a general schematic view of a known synchrotron radiation generation system.

Now, an embodiment of the present invention will now be described with reference to FIGS. 4 and 5. The general arrangement of the synchrotron radiation generation apparatus of this embodiment is similar to that of the known arrangement shown in FIG. 2, and the same reference numerals are used to indicate corresponding components. Furthermore, it can be appreciated that the synchrotron radiation generation apparatus according to the present invention may be used in a synchrotron radiation generation system such as that shown in FIG. 1.

Figure 4:
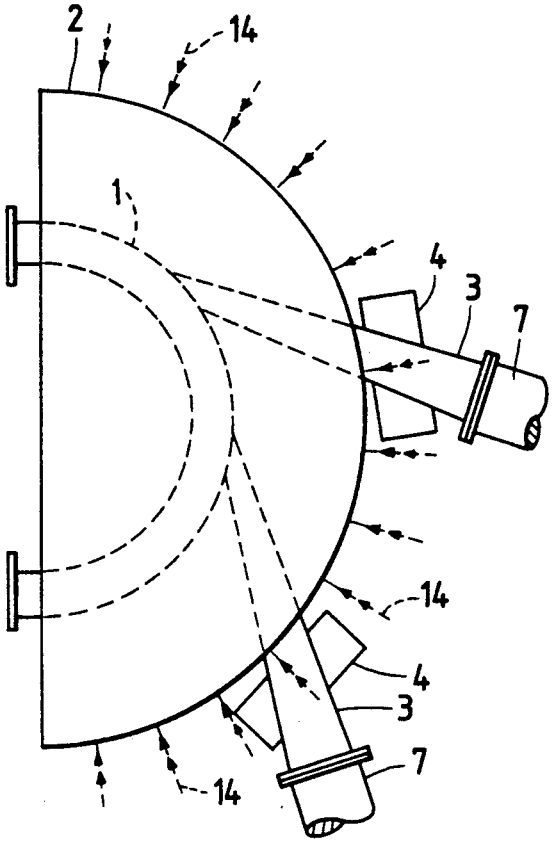
FIG. 4 is a plan view of a first embodiment of a synchrotron radiation apparatus according to the present invention.
Figure 5:
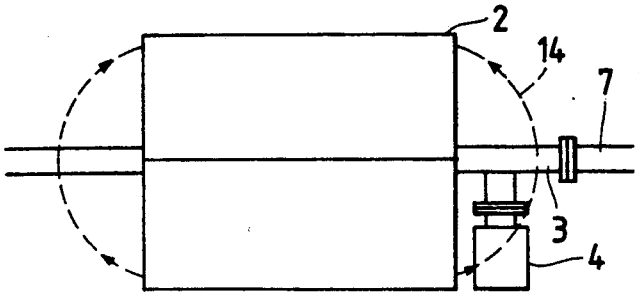
FIG. 5 is a side view of the embodiment of the present invention as shown in FIG. 4.

Referring to FIG. 4, a deflection duct 1 for storing electrons is located in a superconductive bending magnet 2 and SOR radiation lead-out ducts 3 extend from the outer periphery of this deflection duct 1. Each duct 3 is connected to a corresponding SOR radiation beam line 7. An ion pump 4 is connected to each duct 3 on the outer peripheral side of the superconductive bending magnet 2 so as to branch from an intermediate part of the SOR radiation lead-out duct 3.

In the embodiment of FIG. 4 each ion pump 4 is located in such a manner that the direction of the main magnetic field of the ion pump 4 substantially conforms with the main (i.e. largest) component of the leakage magnetic field 14 of the superconductive bending magnet 2. Moreover, the ion pump 4 is fitted so that it is positioned below the SOR radiation lead-out duct 3, as shown by FIG. 5. Substantial conformity of the direction of the main magnetic field of the ion pump 4 with the direction of the leakage magnetic field 14 of the superconductive bending magnet 2 means conformity of the axial direction of the hollow anodes (see FIG. 3) with the direction of the leakage magnetic field of the superconductive bending magnet 2 because the direction 13 of the magnetic field of the ion pump 4 is in comformity with the axial direction of the hollow anodes 9. Thus, the ion pump 4 is located so that the axial direction of the hollow anodes 9 is the same as the direction of the main component of the leakage magnetic field 14 of the superconductive bending magnet 2.

If the ion pump 4 is of the type shown in FIG. 3, having a pump case 8 with cathodes 10 on both sides of the anodes 9 and a magnet 12 outside the ion pump case 8, the axial direction of the hollow anodes 9 or the direction of the magnetic field 13 of the magnet 12 is substantially in conformity with the direction of the main component of the leakage magnetic field 14.

As shown in, FIG. 5 the leakage magnetic field 14 from the superconductive bending magnet 2 occurs from below to above as shown in the drawing and penetrates through the interior of the ion pump 4 with an inclination, depending upon the distance between the duct 3 and the ion pump 4, perpendicular to the plane of the arc of the bending magnet 1. The leakage magnetic field 14 has an inclination, because perpendicular components and tangential components exist in addition to the component of the magnetic field in the radial direction. The influence of these components will be discussed below using specific numerical values.

Figure 6:
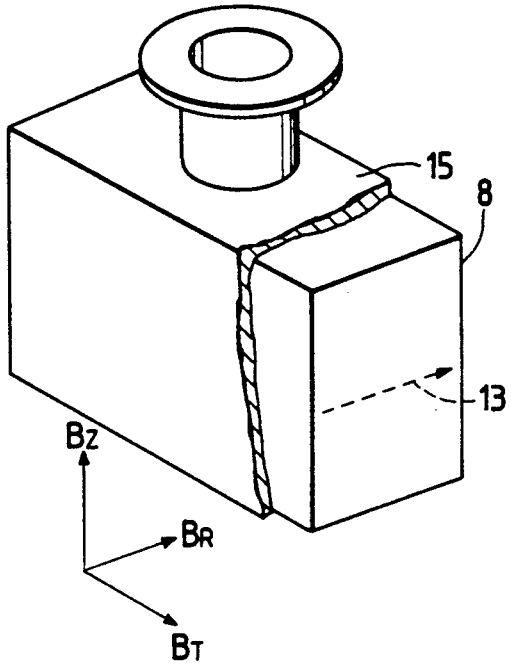
FIG. 6 is a diagram for explaining the relationship between the leakage magnetic field and the orientation of an ion pump.

In FIG. 6, the component of the leakage flux density of the superconductor of the superconductor deflection electromagnet in the radial direction is represented by $B_R$, its component in the tangential direction by $B_T$ and its component in the prependicular direction, by $B_Z$.

Here, the ion pump is located on the outer periphery of the superconductor deflection electromagnet so that the main magnetic field 13 of the ion pump is in alignment with the direction of $B_R$.

It has been experimentally determined that the leakage field flux density acting on the center of an unshielded ion pump is as follows:

$B_R=0.13T$ $B_T=0.025T$ $B_Z=0.04T$

The main magnetic field $B_{IP}$ inherent to the ion pump is:

$B_{IP}=0.12T$

The angle of inclination $\theta$ between the composite magnetic field 16 and the axis of the anode 9 shown in FIG. 6 can be calculated as follows by using the numerical values described above.

$$\begin{aligned}\theta &= \tan^{-1}\frac{\sqrt{B_T^2+B_Z^2}}{\sqrt{(B_{IP}+B_R)^2+B_T^2+B_Z^2}}\\ &= \tan^{-1}\frac{\sqrt{0.025^2+0.04^2}}{\sqrt{(0.12+0.13)^2+0.025^2+0.04^2}}\\ &= \tan^{-1}\frac{0.047}{0.254}\\ &= 10.5^\circ\end{aligned}$$

According to the embodiment described above, the magnetic field inside the anodes 9 of the ion pump 4 can be increased from 0.12T to 0.254T by bringing the direction of the main magnetic field 13 of the ion pump 4 into conformity with the direction of the leakage magnetic field 14 of the superconductive bending magnet 2. Consequently, the electron synchrotron frequency f is increased to approximately double, so that there is a corresponding increase in ionization events in the gas to be exhausted and the pumping performance of the ion pump can be improved.

Figure 7:
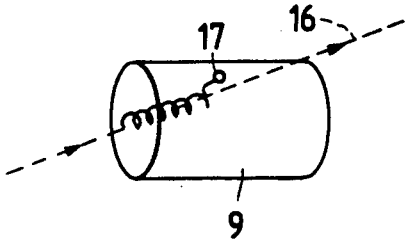
FIG. 7 is a diagram for explaining the relationship between an anode of the ion pump and the vector composite magnetic field.

On the other hand, the vector composite magnetic field 16 is inclined by $\theta=10.5^\circ$ with respect to the axis of the anodes 9 of the ion pump 4 due to the $B_T$ and BZ components. Accordingly, though the performance of the ion pump 4 is reduced by these components, a higher exhaust performance can still be obtained in comparison with the case where the pump is not aligned with the main component of the leakage magnetic field. Incidentally, reference numeral 17 in FIG. 7 represents electrons.

FIG. 6 shows a structure wherein the ion pump 4 is further shielded by a magnetic material 15. The effect on the magnetic field due to this magnetic material 15 will now be examined.

If a 12 mm-thick steel sheet is put on the ion pump 4 on which the leakage magnetic field 14 from the bending magnet 2 acts, the magnitude of the leakage magnetic field acting on the center of the ion pump 4 is reduced as follows:

$B_R=0.035T$ $B_T=0.0T$ $B_Z=0.005T$

Similarly, the angle of inclination $\theta$ is given as follows:

$$\begin{aligned}\theta &= \tan^{-1}\frac{\sqrt{0.005}}{\sqrt{(0.12+0.035)^2+0.005^2}}\\ &= \tan^{-1}\frac{0.005}{0.155}\\ &= 1.8^\circ\end{aligned}$$

As described above, according to the embodiment wherein the leakage magnetic field is added to the main magnetic field of the ion pump 4, the magnitude of the magnetic field inside the ion pump can be increased from 0.12T to 0.155T and the exhaust performance of the ion pump 4 can thus be improved.

The inclination of the vector composite magnetic field in this case is as small as 1.8° and can be neglected.

As a further alternative, the shielding 15 may be provided only so as to reduce the $B_T$ and $B_Z$ components of the leakage field.

Figure 8:
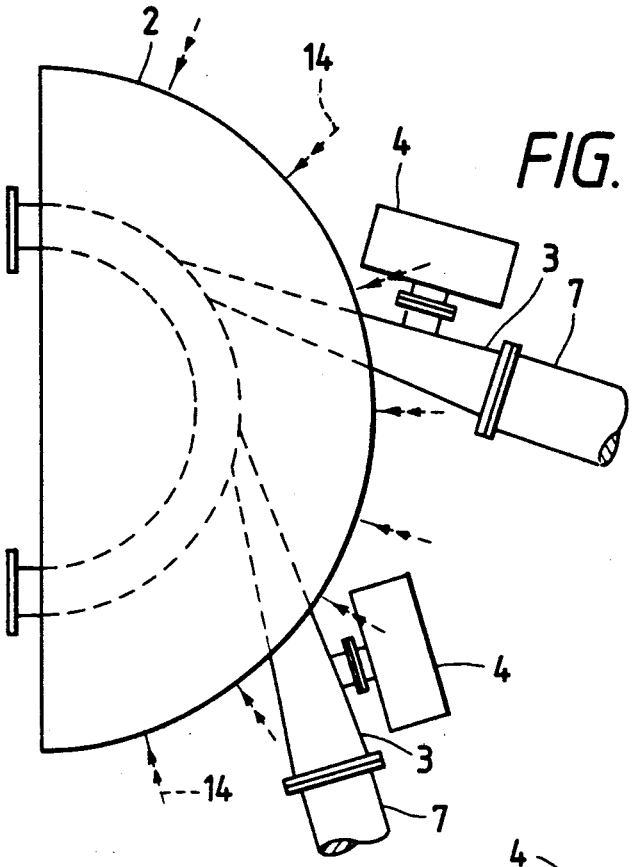
FIG. 8 is a plan view of a second embodiment of the present invention.
Figure 9:
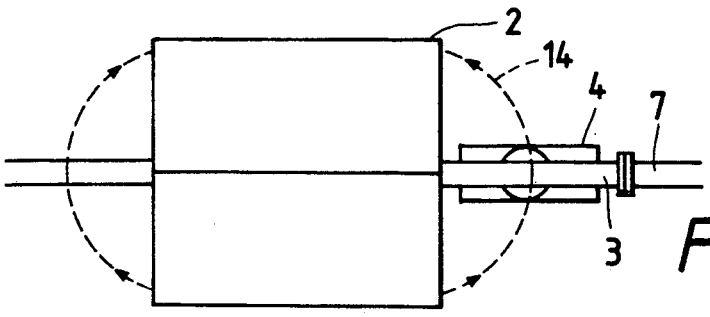
FIG. 9 is a side view of the second embodiment of the present invention shown in FIG. 8.

FIGS. 8 and 9 show another embodiment of the present invention, wherein the ion pump 4 is located at the central horizontal position of the bending magnet 2 and to the side of the lead-out duct 3.

In this embodiment, the direction of the main magnetic field of the ion pump 4 and the direction of the main component of the leakage magnetic field 14 of the bending magnet 2 are substantially in conformity with each other.

In the embodiment shown in FIGS. 8 and 9, the position of the ion pump 4 is such that the main components of the magnetic field is vertical in FIG. 9, and then the radial component is small. The relative magnitudes of $B_R$ and $B_Z$ are thus changed, as compared with the numerical examples discussed above, but the resultant effect is similar if the main magnetic field 13 of ion pump 4 is aligned with $B_Z$.

In the above description, for both the first and second embodiments of the present invention, it has been stated that the main magnetic field 13 in the anodes 9, are aligned with the main component of the leakage field. However, also as described above, that leakage field at any point also may include other components in addition to the main (largest) one. If the main magnetic field 13 of the ion pump 4 is aligned with the main component, those other components reduce the performance of the ion pump 4, but this reduction in performance may be acceptable. However, in order further to improve the performance of the ion pump 4, it is possible for it to be orientated so that the main magnetic field 13 is aligned with the vector composite of the leakage magnetic field 14 at the location of the ion pump 4. Of course, this means that the vector composite direction must be determined, and although this is possible using standard techniques, it adds a further alignment step. In the first and second embodiment as described above, the main component of the leakage field corresponds to either the radial or vertical components of the field, so that it is easier to align the ion pump 4 relative to those radial or vertical directions. On the other hand, if the main magnetic field 13 of the ion pump 4 is aligned with the vector composite direction of the leakage magnetic field, the problem of the effect of components other than the main component is eliminated. Since the change in angle between the vector composite direction and the direction of the main component is small, the arrangement will be very close to that of FIG. 4 or 8.

Figure 10:
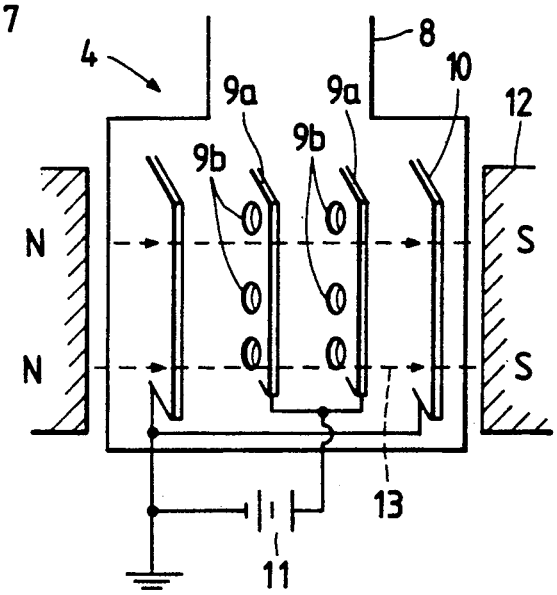
FIG. 10 (PRIOR ART)
FIG. 10 shows another type of ion pump which may be used in the present invention.

FIG. 10 shows another ion pump arrangement which may be used with the present invention as an alternative to the ion pump arrangement shown in FIG. 3. Apart from the anode structure, the ion pump 4 shown in FIG. 10 is generally similar to that shown in FIG. 3, and the same numerals are used to indicate corresponding parts. However, in the ion pump 4 shown in FIG. 10, the anodes are formed by anode plates 9*a* arranged between the cathode plates 10. Although only two anode plates 9*a* are shown in FIG. 10, there are normally more plates 9*a*. The anode plates 9*a* have holes 9*b* therein, and these holes control the movement of electrons within the anodic region. As can be seen from FIG. 10, the axes of these holes 9*b* are aligned with the main magnetic field 13 of the ion pump 4, as generated by magnet 12.

It was mentioned above that it is possible for the present invention to operate with the leakage magnetic field forming the main magnetic field for the ion pump. In this case, the magnet 12 in FIGS. 3 and 10 is omitted, and the ion pump 4 is unshielded. Then, if the ion pump arrangement shown in FIG. 3 is used, the longitudinal axis of the cylindrical anodes 9 are aligned with the vector composite direction (or possibly the main components) of the leakage magnetic field. That leakage magnetic field then acts in exactly the same way as the main magnetic field 13. In a similar way, the ion pump arrangement shown in FIG. 10 is positioned so that the axes of the holes 9*b* of the anode plates 9*a* are aligned with the vector composite direction (or the direction of the main component) of the leakage magnetic field.

Thus, the present invention proposes that the main magnetic field of an ion pump 4 is aligned with the leakage magnetic field (or a main component thereof). Alternatively, the leakage magnetic field may itself form the main magnetic field of the ion pump 4. Therefore, the effect of the leakage magnetic field on the performance of the ion pump is improved, as compared with known system in which the main magnetic field of the ion pump 4 was aligned with the direction of elongation of the corresponding leadout duct 3. Thus, the ion pump 4 may operate in an efficient way, and this the present invention is particularly suitable for a small-sized radiation generation system.

What is claimed is:

1. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generated by said bending of said beam; and an ion pump connected to said at least one duct, said ion pump having field generation means for generating a main magnetic field for said ion pump;

wherein said field generation means of said ion pump is located such that said main magnetic field is substantially aligned with a main component of said leakage magnetic field at said ion pump.

2. An apparatus according to claim 1, wherein said bending magnet is in the form of an arc, and said main component of said leakage magnetic field is radial of said arc.

3. An apparatus according to claim 1, wherein said bending magnet is in the form of an arc, and said main component of said leakage magnetic field is perpendicular to the plane of said arc.

4. An apparatus according to claim 1, wherein said leakage magnetic field has further components, and said ion pump has shielding for reducing said at least one of said further components of said leakage magnetic field.

5. An apparatus according to claim 1, wherein said ion pump has a casing of magnetic shielding material.

6. An apparatus according to claim 1, wherein said ion pump has at least one hollow cylindrical anode for electrons therein, and the longitudinal axis of said at least one cylindrical anode is substantially aligned with said main component of said leakage magnetic field.

7. An apparatus according to claim 1, wherein said ion pump has at least one anode plate having at least one hole therein, and the through axis of said at least one hole is substantially aligned with said main component of said leakage magnetic field.

8. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generated by said bending of said beam; and an ion pump connected to said at least one duct, said ion pump having field generation means for generating a main magnetic field for said ion pump;

wherein said field generation means of said ion pump is located such that said main magnetic field is substantially aligned with the vector composite direction of said leakage magnetic field at the location of said ion pump.

9. An apparatus according to claim 8, wherein said ion pump has a casing of magnetic shielding material.

10. An apparatus according to claim 8, wherein said ion pump has at least one hollow cylindrical anode for containing electrons therein, and the longitudinal axis of said at least one cylindrical anode is substantially aligned with said vector composite direction.

11. An apparatus according to claim 8, wherein said ion pump has at least one anode plate having at least one hole therein, and the through axis of said at least one hole is substantially aligned with said vector composite direction.

12. A synchrotron radiation generation apparatus comprising:

a bending magnet for generating a bending magnetic field for a charged particle beam so as to bend said beam, said bending magnet being in the form of an arc;

at least one duct for defining a path for synchrotron radiation generated by said bending of said beam; and an ion pump connected to said at least one duct having field generation means for generating a main magnetic field for said ion pump;

wherein said main magnetic field is substantially aligned with the radial direction of said arc of said bending magnet.

13. An apparatus according to claim 12, wherein said ion pump is spaced from said duct in a direction perpendicular to the plane of said arc.

14. A synchrotron radiation generation apparatus comprising:

a bending magnet for generating a bending electromagnetic field for a charged particle beam so as to bend said beam, said bending magnet being in the form of an arc;

at least one duct for defining a path for synchrotron radiation generated by said bending of said beam; and an ion pump connected to said at least one duct having field generation means for generating a main magnetic field for said ion pump;

wherein said main magnetic field is aligned so as to be substantially perpendicular to the plane of said arc of said bending magnet.

15. An apparatus according to claim 14, wherein said ion pump is spaced from said duct in a direction parallel to said plane of said arc.

16. A synchrotron radiation generation apparatus comprising:

a bending magnet for generating a bending magnetic field for a charged particle beam so as to bend said beam;

a duct for defining a path for synchrotron radiation generated by said bending of said beam, said duct extending in a first direction; and an ion pump connected to said duct, said ion pump having field generation means for generating a main magnetic field for said ion pump;

wherein said field generation means of said ion pump is located such that said main magnetic field is aligned in a second direction, said second direction being different from said first direction.

17. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generation by said bending of said beam; and an ion pump for connecting to said at least one duct; said ion pump requiring a main magnetic field for the operation thereof;

wherein said ion pump is located in said leakage magnetic field such that said leakage magnetic field forms said main magnetic field of said ion pump.

18. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generated by said bending of said beam; and an ion pump connected to said at least one duct, said ion pump having at least one hollow cylindrical anode for containing electrons therein;

wherein the longitudinal axis of said at least one cylindrical anode of said ion pump is substantially aligned with a main component of said leakage magnetic field at said ion pump.

19. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generated by said bending of said beam; and an ion pump connected to said at least one duct, said ion pump having at least one hollow cylindrical anode for containing electrons therein;

wherein the longitudinal axis of said at least one cylindrical anode of said ion pump is substantially aligned with the vector composite direction of said leakage magnetic field at the location of said ion pump.

20. A synchrotron radiation generation apparatus comprising:

a bending magnet for generating a bending magnetic field for a charged particle beam so as to bend said beam, said bending magnet being in the form of an arc;

at least one duct for defining a path for synchrotron radiation generated by said bending of said beam; and an ion pump connected to said at least one duct, said ion pump having at least one hollow cylindrical anode for containing electrons therein;

wherein the longitudinal axis of at least one cylindrical anode of said ion pump is substantially aligned with the radial direction of said arc of said bending magnet.

21. A synchrotron radiation generation apparatus comprising:

a bending magnet for generating a bending electromagnetic field for a charged particle beam so as to bend said beam, said bending magnet being in the form of an arc;

at least one duct for defining a path for synchrotron radiation generated by said bending of said beam; and an ion pump connected to said at least one duct said ion pump having at least one cylindrical anode for containing electrons therein;

wherein the longitudinal axis of said cylindrical anode of said ion pump is aligned so as to be substantially perpendicular to the plane of said arc of said bending magnet.

22. A synchrotron radiation generation apparatus comprising:

a bending magnet for generating a bending magnetic field for a charged particle beam so as to bend said beam;

a duct for defining a path for synchrotron radiation generated by said bending of said beam, said duct extending in a first direction; and an ion pump connected to said duct, said ion pump having at least one hollow cylindrical anode for containing electrons therein;

wherein the longitudinal axis of said at least one cylindrical anode of said ion pump is aligned in a second direction, said second direction being different from said first direction.

23. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generated by said bending of said beam; and an ion pump connected to said at least one duct, said ion pump having at least one anode plate having at least one hole therein;

wherein the through axis of said at least one hole of said at least one anode plate of said ion pump is substantially aligned with a main component of said leakage magnetic field at the location of said ion pump.

24. A synchrotron radiation generation apparatus comprising:

a bending magnet for generating a bending magnetic field for a charged particle beam so as to bend said beam, said bending magnet also causing a leakage magnetic field to be generated;

at least one duct for defining a path for synchrotron radiation generated by said bending of said beam; and an ion pump connected to said at least one duct, said ion pump having at least one anode plate having at least one hole therein;

wherein the through axis of said at least one anode plate of said ion pump is substantially aligned with the vector composite direction of said leakage magnetic field at the location of said ion pump.

25. A synchrotron radiation generation apparatus comprising:

a bending magnet for generating a bending magnetic field for a charged particle beam so as to bend said beam, said bending magnet being in the form of an arc;

at least one duct for defining a path for synchrotron radiation generated by said bending of said beam; and an ion pump connected to said at least one duct, said ion pump having at least one ion plate having at least one hole therein;

wherein the through axis of said at least one hole is substantially aligned with the radial direction of said arc of said bending magnet.

26. A synchrotron radiation generation apparatus comprising:

a bending magnet for generating a bending electromagnetic field for a charged particle beam so as to bend said beam, said bending magnet being in the form of an arc;

at least one duct for defining a path for synchrotron radiation generated by said bending of said beam; and an ion pump connected to said at least one duct said ion pump having at least one anode plate having at least one hole therein;

wherein the through axis of said at least one hole is substantially perpendicular to the plane of said arc of said bending magnet.

27. A synchrotron radiation generation apparatus comprising:

a bending magnet for generating a bending magnetic field on a charged particle beam so as to bend said beam;

a duct for defining a path for synchrotron radiation generated by said bending of said beam, said duct extending in a first direction; and an ion pump connected to said duct, said ion pump having at least one hole therein;

wherein the through axis of said at least one hole is aligned in a second direction, said second direction being different from said first direction.

28. A method of generating synchrotron radiation, comprising:

generating a bending magnetic field and a leakage magnetic field;

generating a main magnetic field in an ion pump connected to at least one duct;

aligning said ion pump such that said main magnetic field of said ion pump is substantially aligned with a main component of said leakage magnetic field at at least said ion pump;

causing a charged particle beam to bend due to said bending magnetic field, thereby to generate synchrotron radiation; and causing said synchrotron radiation to pass in said duct.

29. A method of generating synchrotron radiation, comprising:

generating a bending magnetic field and a leakage magnetic field;

generating a main magnetic field in an ion pump connected to at least one duct;

aligning said ion pump such that said main magnetic field of said ion pump is substantially aligned with the vector composite direction of said leakage magnetic field at said ion pump;

causing a charged particle beam to bend due to said bending magnetic field, and thereby to generate synchrotron radiation; and causing said synchrotron radiation to pass in said duct.

30. A method of generating synchrotron radiation, comprising:

generating a ending magnetic field by means of a bending magnet in the form of an arc;

generating a main magnetic field in an ion pump connected to at least one duct;

aligning said ion pump such that said main magnetic field of said ion pump is substantially aligned with the radial direction of said arc of said bending magnet;

causing a charged particle beam to bend due to said bending magnet, thereby to generate synchrotron radiation; and causing said synchrotron radiation to pass in said duct.

31. A method of generating synchrotron radiation, comprising:

generating a bending magnetic field by means of a bending magnet in the form of an arc;

generating a main magnetic field in an ion pump connected to at least one duct;

aligning said ion pump such that said main magnetic field of said ion pump is substantially aligned perpendicular to the plane of said arc of said bending magnet;

causing a charged particle beam to bend due to said bending magnet, thereby to generate synchrotron radiation; and causing said synchrotron radiation to pass in said duct.

32. A method of generating synchrotron radiation, comprising:

generating a bending magnetic field and a leakage magnetic field;

causing a charged particle beam to bend due to said bending magnetic field, thereby to generate synchrotron radiation; and causing said synchrotron radiation to pass in a duct;

wherein said leakage field forms a main magnetic field for an ion pump connected to said duct.

33. A synchrotron radiation generation system comprising:

a plurality of bending magnets, each for generating a bending magnetic field on a charged particle beam, thereby to define a looped path for said beam, each of said plurality of bending magnets also causing a leakage magnetic field to be generated;

at least one duct for defining a path for synchrotron radiation generated by bending of said beam by one of said bending magnets; and an ion pump connected to said at least one duct, said ion pump having field generation means for generating a main magnetic field for said ion pump;

wherein said field generation means of said ion pump is located such that said main magnetic field is substantially aligned with a main component of said leakage magnetic field of said one of said bending magnets at said ion pump.

34. A synchrotron radiation generation system comprising:

a plurality of bending magnets, each for generating a bending magnetic field on a charged particle beam, thereby to define a looped path for said beam, each of said plurality of bending magnets also causing a leakage magnetic field to be generated;

at least one duct for defining a path for synchrotron radiation generated by bending of said beam by one of said bending magnets; and an ion pump connected to said at least one duct, said ion pump having field generation means for generating a main magnetic field for said ion pump;

wherein said field generation means of said ion pump is located such that said main magnetic field is substantially aligned with the vector composite direction of said leakage magnetic field at the location of said ion pump.

* * * * *